US011014090B2

(12) United States Patent
Bergman et al.

(10) Patent No.: US 11,014,090 B2
(45) Date of Patent: May 25, 2021

(54) GYRATORY CRUSHER MAIN SHAFT AND ASSEMBLY

(71) Applicant: SANDVIK INTELECTUAL PROPERTY AB, Sandviken (SE)

(72) Inventors: Axel Bergman, Malmo (SE); Mikael M Larsson, Eslov (SE); Patric Malmqvist, Svedala (SE); Anders Hallberg, Sodra Sandby (SE); Matts-Ake Nilsson, Gards Kopinge (SE); Fredrik Eriksson, Malmo (SE); Bengt-Arne Eriksson, Svedala (SE); Anne Holmberg, Loddekopinge (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 348 days.

(21) Appl. No.: 15/035,774

(22) PCT Filed: May 23, 2014

(86) PCT No.: PCT/EP2014/060594
§ 371 (c)(1),
(2) Date: May 11, 2016

(87) PCT Pub. No.: WO2015/070993
PCT Pub. Date: May 21, 2015

(65) Prior Publication Data

US 2016/0271614 A1 Sep. 22, 2016

(30) Foreign Application Priority Data

Nov. 12, 2013 (EP) ..... 13192402

(51) Int. Cl.

| | |
|---|---|
| ***B02C 2/00*** | (2006.01) |
| ***B02C 2/06*** | (2006.01) |
| ***B02C 2/04*** | (2006.01) |
| ***B02C 2/02*** | (2006.01) |

(52) U.S. Cl.
CPC ..... *B02C 2/06* (2013.01); *B02C 2/02* (2013.01); *B02C 2/04* (2013.01)

(58) Field of Classification Search
CPC ..... B02C 2/02; B02C 2/04; B02C 2/06
USPC ..... 241/207–209
See application file for complete search history.

(56) References Cited

U.S. PATENT DOCUMENTS

| | | | |
|---|---|---|---|
| 1,402,255 | A | 1/1922 | Sanborn |
| 1,592,313 | A | 6/1925 | Symons |
| 1,748,102 | A | 2/1930 | Bernhard |

(Continued)

FOREIGN PATENT DOCUMENTS

| | | | |
|---|---|---|---|
| CN | 201179454 | Y | 1/2009 |
| CN | 201431896 | Y | 3/2010 |

(Continued)

*Primary Examiner* — Faye Francis
(74) *Attorney, Agent, or Firm* — Corinne R. Gorski

(57) ABSTRACT

A gyratory crusher main shaft assembly has a main shaft, an axially upper region of the main shaft including a tapered conical section with a protective sleeve friction fitted over the cone. To facilitate mounting and dismounting of the sleeve, at least one groove is indented within a radially external facing surface of the main shaft at the region of the cone to allow fluid to be introduced under pressure to the region between the sleeve and the cone.

14 Claims, 4 Drawing Sheets

(56) References Cited

U.S. PATENT DOCUMENTS

| | | | | | |
|---|---|---|---|---|---|
| 2,916,218 | A * | 12/1959 | Werner | B02C 2/04 | 241/208 |
| 3,456,889 | A | 7/1969 | Burkhardt et al. | | |
| RE27,970 | E * | 4/1974 | Johnson | B02C 2/04 | 241/202 |
| 3,813,047 | A | 5/1974 | Torrence et al. | | |
| 3,891,153 | A * | 6/1975 | Decker | B02C 2/047 | 241/208 |
| 4,027,825 | A | 6/1977 | Coxhill | | |
| 5,718,391 | A * | 2/1998 | Musil | B02C 2/045 | 241/207 |
| 5,934,583 | A | 8/1999 | Jean | | |
| 5,944,265 | A * | 8/1999 | Ganser, IV | B02C 2/00 | 241/207 |
| 6,213,418 | B1 * | 4/2001 | Gabriel | B02C 2/04 | 241/207 |
| 7,048,214 | B2 * | 5/2006 | Johnson | B02C 2/00 | 241/207 |
| 7,922,109 | B2 * | 4/2011 | Persson | B02C 2/047 | 241/209 |
| 2002/0088885 | A1 | 7/2002 | Van Mullem et al. | | |
| 2003/0102394 | A1 | 6/2003 | Martinez et al. | | |
| 2009/0008489 | A1 * | 1/2009 | Nieminen | B02C 2/047 | 241/207 |

FOREIGN PATENT DOCUMENTS

| | | | |
|---|---|---|---|
| CN | 201807388 | U | 4/2011 |
| CN | 203170383 | U | 9/2013 |
| FR | 531391 | A | 1/1922 |
| FR | 2492022 | A1 | 4/1982 |
| SU | 87056 | A1 | 11/1949 |
| SU | 718160 | A1 | 2/1980 |
| SU | 940837 | A1 | 7/1982 |
| WO | 9715395 | A1 | 5/1997 |

* cited by examiner

GYRATORY CRUSHER MAIN SHAFT AND ASSEMBLY

RELATED APPLICATION DATA

This application is a § 371 National Stage Application of PCT International Application No. PCT/EP2014/060594 filed May 23, 2014 claiming priority of EP Application No. 13192402.9, filed Nov. 12, 2013.

FIELD OF INVENTION

The present invention relates to a gyratory crusher main shaft and main shaft assembly for positioning within a gyratory crusher and in particular, although not exclusively, to a main shaft having an axial upper end region that tapers radially inward and comprises at least one groove to receive a pressurised fluid to facilitate mounting and demounting of a sleeve at the shaft.

BACKGROUND ART

Gyratory crushers are used for crushing ore, mineral and rock material to smaller sizes. Typically, the crusher comprises a crushing head mounted upon an elongate main shaft. A first crushing shell is mounted on the crushing head and a second crushing shell is mounted on a frame such that the first and second crushing shells define together a crushing chamber through which the material to be crushed is passed.

The gyratory pendulum movement of the crushing head is supported by a lower bearing assembly positioned below the crushing head and a top bearing into which an upper end of the main shaft is journalled. Typically, the main shaft upper end is protected against wear by a sleeve. Commonly, the protective sleeve comprises a cylindrical geometry and is held at the main shaft via an interference or friction fit. Example protective sleeves are disclosed in U.S. Pat. Nos. 1,402,255; 1,592,313; 1,748,102; RU 718160; U.S. Pat. No. 4,027,825; RU 940837 and U.S. Pat. No. 5,934,583.

However, a number of problems exist with conventional protective sleeves. In particular, if the time taken to friction fit the heated sleeve onto the main shaft end is too great it is not uncommon for the sleeve to cool and shrink before it is forced onto the shaft to the correct and final position. Additionally, disassembly is often problematic as the sleeve is required to be cut before it can be removed. On large crushers, protective sleeves have a substantial wall thickness and this cutting operation can be time and labour intensive with the added risk of potential damage to the shaft. Conventional mounting and dismounting procedures, due to the design of the main shaft and sleeve, are therefore disadvantageous in that they pose a risk of damage to the main shaft (and other components), injury to personnel and unacceptably long downtime of the crusher during repair and maintenance. Accordingly, what is required is a main shaft and main shaft assembly having a sleeve that addresses the above problems.

SUMMARY OF THE INVENTION

It is an objective of the present invention to provide a gyratory crusher main shaft and a main shaft assembly (having a sleeve) that enables convenient mounting and dismounting of the protective sleeve at the upper end of the shaft that obviates a requirement for excessive heating of the main shaft and the use of grinding and cutting apparatus that otherwise carries a risk of damage to the main shaft and injury to service personnel.

It is a further specific objective of the present invention to provide a main shaft and sleeve assembly that facilitates mounting and dismounting of the sleeve at the shaft via control of a pressurised fluid delivered to the region of an axially upper end of the shaft radially between the shaft and the sleeve.

The objectives are achieved by providing a main shaft comprising at least one groove or channel indented on an outward facing external surface of the shaft. The groove is configured and dimensioned to receive a fluid under pressure to force separation of the sleeve from the main shaft. Providing the groove at the main shaft as opposed to the sleeve, is advantageous to maintain the strength and integrity of the sleeve to avoid fracture or splitting in response to the introduction of the pressurised fluid radially between the main shaft and the sleeve. The present invention is advantageous to allow the fluid to be introduced into the region between the main shaft and the sleeve via different routing options including in particular i) a conduit extending axially and/or radially at and/or within the main shaft and ii) a supply conduit extending through the sleeve wall. Reference to the conduit extending axially encompasses the conduit being aligned transverse or parallel to the longitudinal axis of the main shaft.

As will be appreciated, the subject invention is compatible for use with existing fluid supply arrangements including conduits, pumps, fluid reservoirs, seals, gaskets etc.

According to a specific aspect of the present invention there is provided a gyratory crusher main shaft comprising: a shaft body having a radially outward facing external surface and having a first end for positioning at a lower region of the crusher and a second end for positioning at an upper region of the crusher relative to the first end; an axial region of the shaft body extending from the second end is tapered relative to a longitudinal axis of the shaft body such that a cross sectional area of the shaft body at the tapered region decreases in a direction from the first end to the second end, the tapered region configured to mount a shaft sleeve; characterised by: at least one groove indented at the external surface and positioned at the tapered region and capable of receiving a pressurised fluid to facilitate mounting and dismounting of the sleeve at the shaft body.

The subject invention provides for the convenient and efficient mounting and dismounting of the sleeve at the main shaft by virtue of the combination of the fluid filled grooves or channels, at the external surface of the main shaft and the radially tapered end section of the main shaft onto which the sleeve is mounted. Without this radially tapered upper end section, the sleeve would still require significant manual intervention to provide axial movement over the surface of the shaft. The conical profiled and grooved main shaft section in combination with a corresponding tapered sleeve is therefore advantageous to firstly allow the fluid to be introduced and then to greatly facilitate and provide immediate axial movement of the sleeve relative to the main shaft.

Preferably, the main shaft further comprises a fluid inlet conduit extending axially from the second end and provided in fluid communication with the groove to allow a fluid to be supplied to the groove from the second end. Positioning the inlet conduit internally at the main shaft is advantageous to avoid routing the fluid through the sleeve which would otherwise require modification and a potential weakening of the sleeve and in particular the sleeve wall. Preferably, the conduit extends internally within the shaft body such that a part of the conduit extends radially outward to the groove. Optionally, at least a part of the conduit is indented and extends axially at the external surface as a channel. The channel may preferably extend axially at the external surface between a plurality of grooves to couple the grooves in fluid communication. Such an arrangement is advantageous to reduce the axial length of any internal bore through the main shaft. Minimising an axial length of an internally extending fluid supply conduit is advantageous during manufacture as the use of very long and thin drills should be avoided. A channel or groove indented on the external surface of the main shaft is therefore more convenient and efficient for manufacture.

Preferably, the groove extends in a circumferential direction around the shaft body. More preferably, the groove extends substantially completely circumferentially around the shaft body. The circumferentially extending groove is advantageous to provide a supply of fluid in a circumferential direction between the main shaft and the sleeve to ensure a uniform expansion pressure and lubrication during dismounting and mounting. Accordingly, 'dry' regions that could otherwise lead to 'sticking' or 'freezing' are avoided.

Preferably, the main shaft comprises a plurality of grooves at the external surface. This configuration provides that the fluid is supplied to different axial regions between the main shaft and sleeve to facilitate uniform delivery and dispersion of the fluid between the respective contact surfaces. Optionally, the main shaft comprises a first groove extending in a circumferential direction around the shaft body and second groove extending in a circumferential direction around the shaft body, the first groove separated axially from the second groove and coupled in fluid communication, optionally via one or more axially extending channels. Preferably, the first groove and the second groove are separated axially by an equal distance from a cross sectional area centre of the sleeve. Accordingly, the expansion force imparted to the sleeve is distributed uniformly along the axial length of the sleeve to both facilitate mounting and dismounting and avoid fracture or distortion of the sleeve. Reference to the 'cross sectional centre' refers to the cross section through the sleeve in an axial plane extending parallel to the longitudinal axis of the sleeve (and the main shaft). As the sleeve comprises a wall that is tapered according to a conical configuration, the cross sectional centre is positioned closer to the upper axial end of the sleeve having the thicker wall thickness relative to the alternate lower axial end.

According to a second aspect of the present invention there is provided a gyratory crusher main shaft assembly comprising: a shaft body as claimed herein; a sleeve fitted over the tapered region, the sleeve having a tapered wall thickness such that a wall thickness at a second upper end of the sleeve is greater than a wall thickness at a first lower end of the sleeve.

Preferably, the assembly further comprises an end retainer releasably mounted at the second end of a shaft body and having a perimeter region extending radially outward beyond the external surface at the tapered region, the perimeter region positioned to radially overlap the sleeve at the second end of the sleeve to inhibit axial separation of the sleeve from the shaft body. Preferably, the retainer is releasably attached to the shaft during mounting and dismounting procedures via a plurality of attachment elements and in particular bolts or screws.

Preferably, the retainer comprises a disc-like configuration having a recess extending circumferentially at the perimeter region to allow axial movement of the sleeve into the recess. Such an arrangement is advantageous to allow a controlled axial movement of the sleeve during dismounting in response to introduction of the pressurised fluid but to inhibit complete axial separation of the sleeve from the main shaft by abutment with the retainer. Naturally, the sleeve may be removed once the retainer has been removed from the main shaft end. The retainer is also configured to force the sleeve over and about the main shaft by axial advancement of suitable attachment bolts, screws and the like.

Preferably, the assembly further comprises a fluid inlet conduit extending axially from the second end of the shaft body in fluid communication with the groove to allow a fluid to be supplied to the groove from the second end.

According to a specific embodiment, the assembly may optionally comprise a fluid inlet conduit extending radially through the wall of the sleeve in fluid communication with the groove to allow a fluid to be supplied to the groove through the sleeve.

According to a third aspect of the present invention there is provided a gyratory crusher comprising a main shaft or main shaft assembly as claimed herein.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
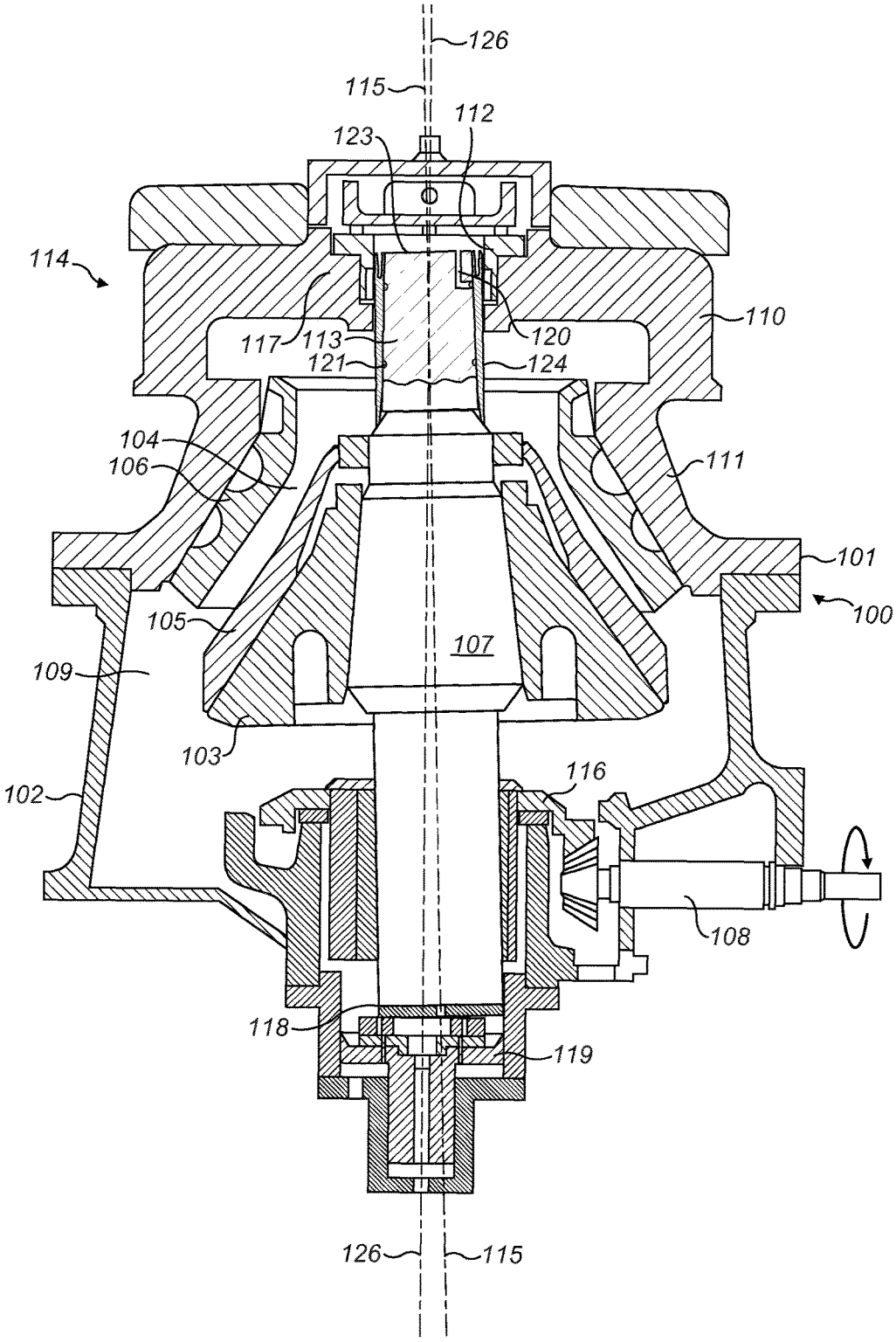
FIG. 1 is a cross sectional side view of a gyratory crusher having a main shaft supported at its upper end by a top bearing assembly and having a protective sleeve mounted about the upper end of the main shaft according to a specific implementation of the present invention.

Referring to FIG. 1, a crusher comprises a frame 100 having an upper frame 101 and a lower frame 102. A crushing head 103 is mounted upon an elongate shaft 107 having a longitudinal axis 115. A first (inner) crushing shell 105 is fixably mounted on crushing head 103 and a second (outer) crushing shell 106 is fixably mounted at upper frame 101. A crushing zone 104 is formed between the opposed crushing shells 105, 106. A discharge zone 109 is positioned immediately below crushing zone 104 and is defined, in part, by lower frame 102.

A drive (not shown) is coupled to main shaft 107 via a drive shaft 108 and suitable gearing 116 so as to rotate shaft 107 eccentrically about a longitudinal axis 126 of the crusher and to cause head 103 to perform a gyratory pendulum movement and crush material introduced into crushing chamber 104. A first (axial upper) end region 113 of shaft 107 is maintained in a rotatable position by a top-end bearing assembly 112 positioned intermediate between main shaft 107 and a central boss 117. Similarly, a second (axial bottom) end 118 of shaft 107 is supported by a bottom-end bearing assembly 119. Upper frame 101 is divided into an upper frame part (commonly termed a topshell 111) mounted upon lower frame part 102 (commonly termed a bottom shell), and a spider assembly 114 having arms 110 that extend from topshell 111 and represents an upper portion of the crusher.

Upper end region 113 comprises a radial taper that defines an upper conical region of main shaft 107. The conical region 113 is tapered so as to decrease in cross sectional area in a direction from shaft second (lower) end 118 to an upper end surface 123 positioned uppermost within the crusher. To avoid excessive wear of the conical region 113, by contact with bearing assembly 112, a substantially cylindrical wear sleeve 124 is mounted over and about region 113. Sleeve 124 is held in position at region 113 by an interference or friction fit and is provided in close touching contact over an axial length of both sleeve 124 and region 113. Accordingly, sleeve 124 is positioned radially intermediate bearing assembly 112 and an outer surface of region 113 to absorb the radial and axial loading forces resultant from the crushing action of the gyratory pendulum movement.

To facilitate mounting and dismounting of sleeve 124 at shaft region 113, shaft 107 is configured to enable a fluid to be introduced into the contact region between the sleeve 124 and shaft region 113. In particular, a fluid supply conduit 120 extends axially and radially along shaft 107 (within region 113) from end surface 123 to the contact region between sleeve 124 and region 113. A channel (alternatively termed a groove) 121 is indented within the external facing surface of shaft 107 at region 113 and is provided in fluid communication with conduit 120.

Figure 2:
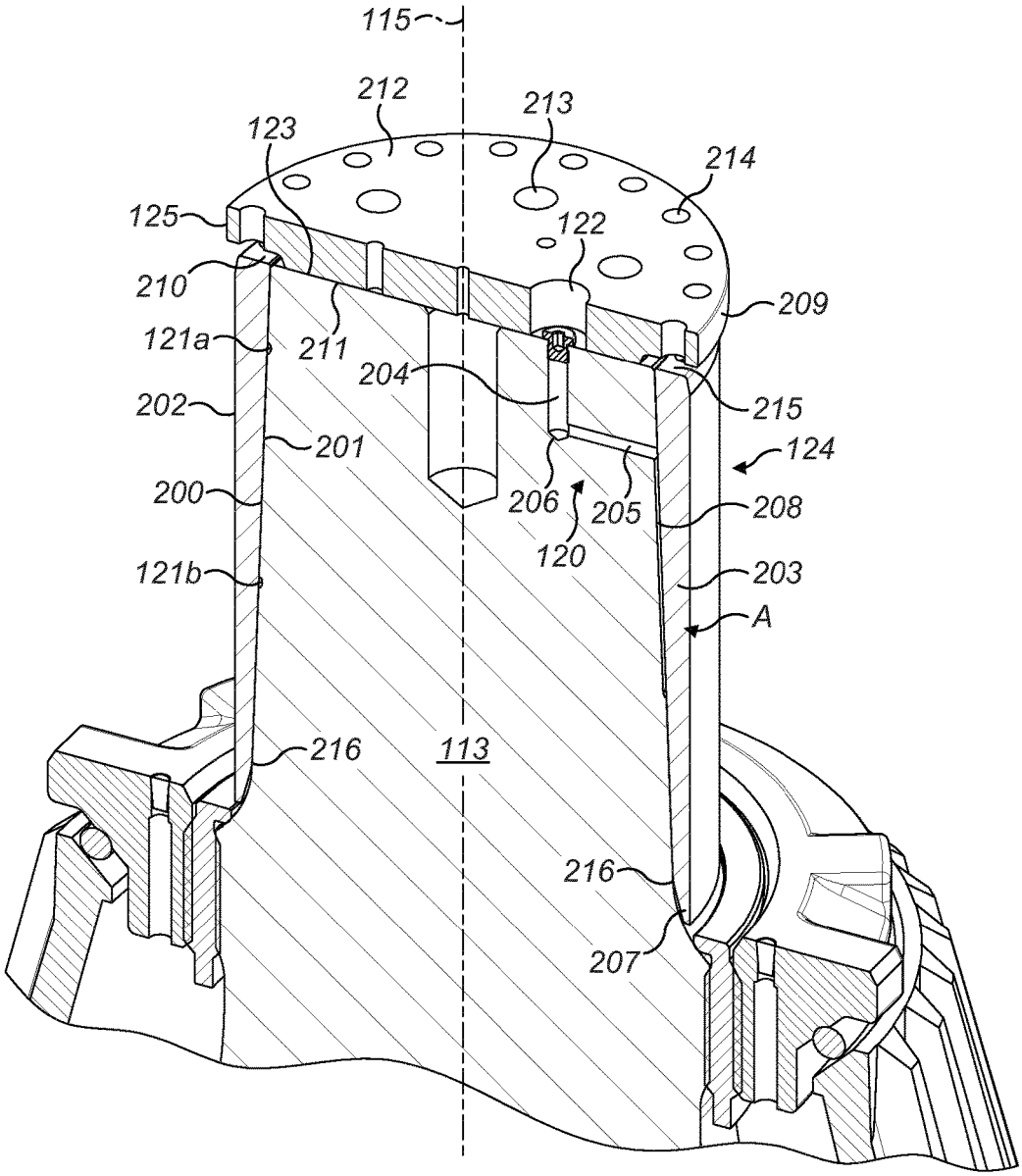
FIG. 2 is a perspective partial cross section through the upper end of the main shaft and sleeve assembly.
Figure 3:
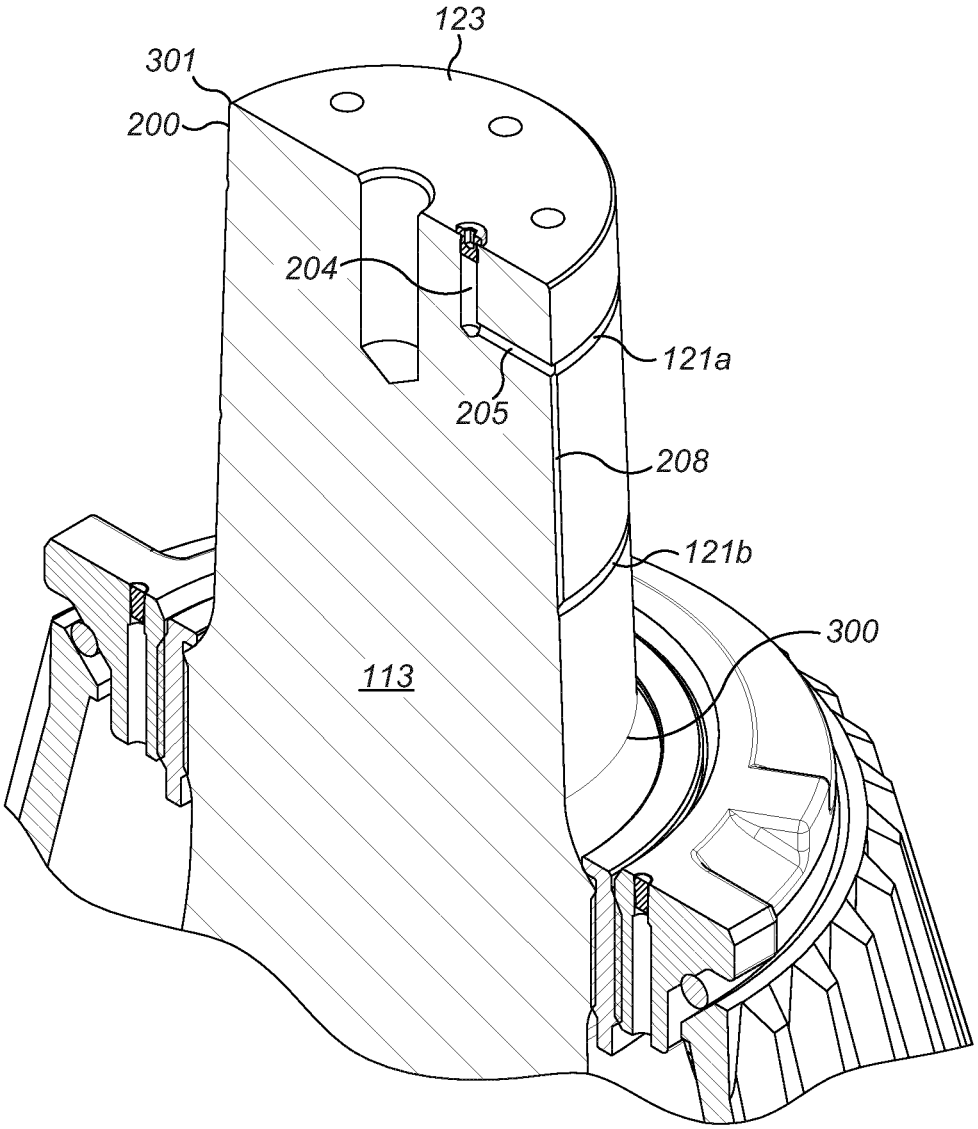
FIG. 3 is a perspective partial cross section of the shaft upper end of FIG. 2 with the protective sleeve removed.
Figure 4:
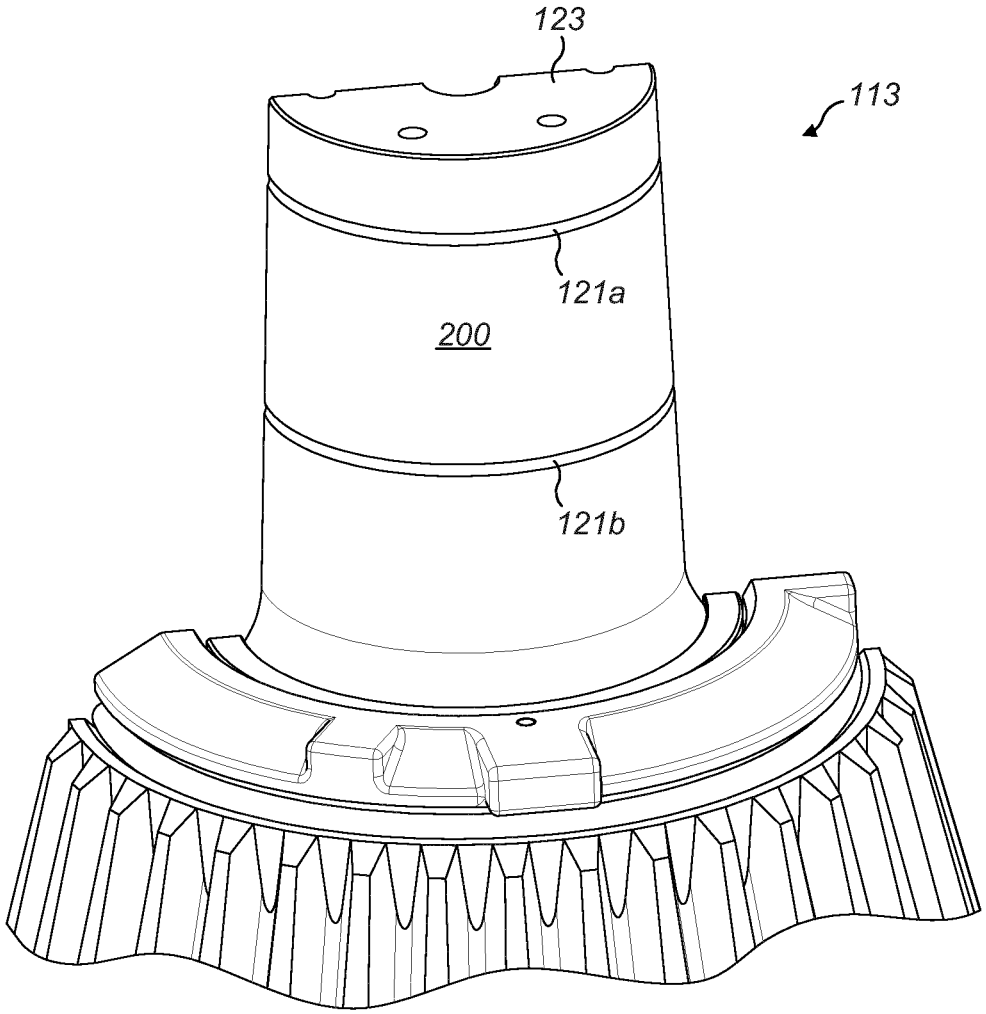
FIG. 4 is a further external perspective view of the tapered axial section of the main shaft upper end of FIG. 3.

Referring to FIGS. 2 to 4 tapered region 113 comprises a lowermost end 300 and an uppermost end 301. The radial taper is uniform along the axial length between ends 300, 301 such that a cross sectional area decreases from lower end 300 to upper end 301 at a uniform rate to define a frusto-conical region (113) of main shaft 107. Sleeve 124 comprises a first (lower) end 216 for mating at the end 300 of region 113 and a second (upper) end 215 for positioning at uppermost end 301 substantially coplanar with shaft end surface 123. Sleeve 124 comprises a radially inward facing surface 201 and a radially outward facing surface 202 with a substantially cylindrical wall 203 defined between surfaces 201, 202. Wall 203 is tapered so as to decrease in radial thickness from uppermost end 215 to lowermost end 216. In particular, external surface 202 is substantially cylindrical whilst internal surface 201 comprises a conical shape profile corresponding to the conical shape profile of main shaft region 113. Region A, illustrated in FIG. 2, corresponds to a mid-axial length position as defined by the cross sectional area of wall 203 (in a plane extending along axis 115) such that the cross sectional area axially above region A is equal to the cross sectional area axially below region A. Sleeve 124 and in particular radially inward facing surface 201 is mated in close fitting contact with the external facing surface 200 of main shaft region 113 between respective lower (216, 300) and upper (215, 301) ends.

Sleeve lower end 216 comprises a chamfer region 207 of decreasing wall thickness such that very a lowermost end region of sleeve 124 is chamfered to sit close to a radius section of main shaft region 113 below region end 300.

A disc-like retainer 125 is releasably mounted over shaft end surface 123 during mounting and dismounting of sleeve 124 at main shaft region 113. Retainer 125 comprises a suitable bore 122 aligned coaxially with an end region of conduit 120 to allow fluid to be introduced through retainer 125 to groove 121 via conduit 120. Retaining disc 125 comprises a plurality of perimeter bores 214 distributed circumferentially around retainer 125 immediately inside of a perimeter 209. Bores 214 are configured to receive attachment bolts (not shown) received within corresponding bores (not shown) extending axially from sleeve upper end 215 so as to lock retainer 125 to sleeve 124 during mounting and dismounting procedures. Retainer 125 further comprises a plurality of additional bores 213 positioned radially inside perimeter bores 214 that are configured to receive attachment bolts (not shown) to secure retainer 125 to main shaft region 113. In particular, an underside surface 211 of retainer 125 is positioned in contact and aligned substantially coplanar with the shaft end surface 123. In this orientation, an upward facing retainer surface 212 is orientated away from main shaft 107. An annular recess 210 extends circumferentially around retainer perimeter 209 and is indented in surface 211 so as to create a small axially and radially extending annular gap region immediately axially above the annular sleeve end 215.

Accordingly, during a sleeve dismounting operation, the sleeve attachment bolts (not shown) are removed. Sleeve 124 is capable of sliding axially into the gap region defined by recess 210 to contact the underside surface 211 (at the recess 210) when fluid pressure is applied. In an alternative mounting operation, retainer 125 is inverted such that disc surface 212 is mated against sleeve end 215 and main shaft end surface 123 to force sleeve 124 axially over and about region 113 as the attachment bolts (not shown) are tightened.

Fluid supply conduit 120 comprises an axial section 204 extending downwardly from end surface 123. A lowermost end 206 of axial section 204 is terminated by a radially extending section 205 that terminates at shaft external facing surface 200. A radially outermost end of the conduit section 205 is provided in fluid communication with an axially upper groove 121*a* that extends circumferentially around shaft region 113.

According to the specific implementation, conical region 113 further comprises a second circumferentially extending groove 121*b* axially separated from the first upper groove 121*a* by a distance approximately half the axial length of region 113 and sleeve 124. Additionally, each groove 121*a*, 121*b* is spaced axially from region A by an equal axial distance. Grooves 121*a* and 121*b* also extend the full 360° circumference of shaft surface 200. An interconnecting fluid flow channel 208 extends axially from upper groove 121*a* to lower groove 121*b* to provide fluid communication between the two grooves 121*a*, 121*b*.

According to further specific implementations, region 113 may comprise a plurality of interconnecting fluid flow channels 208 distributed circumferentially around surface 200. According to yet further embodiments, region 113 may comprise a single circumferentially extending groove optionally in the form of at least one spiral or helix. According to a further embodiment, external facing surface 200 may comprise a network of grooves orientated and extending axially parallel or transverse to axis 115 and/or in a circumferential direction entirely or partly around the conical surface 200.

The subject invention is compatible for use with conventional fluid supply systems (comprising reservoirs, pumps, conduits, seals etc.) coupled to bore 122 via suitable enclosures or conduits. Accordingly, a fluid is capable of being delivered to grooves 121*a*, 121*b* via supply conduits 120, 208 to lubricate the interface between shaft surface 200 and sleeve surface 201. Such an arrangement facilitates both a slide mounting of sleeve 124 and imparts a radial expansion force (to sleeve 124) to promote sleeve demounting.

According to further specific embodiments, shaft region 113 may be devoid of conduit 120 such that sleeve 124 comprises a conduit bore extending through sleeve wall 203 in fluid communication with grooves 121*a*, 121*b* and/or channel 208.

The invention claimed is:

1. A gyratory crusher main shaft of a crusher comprising:

a shaft body having a radially outward facing external surface, and a first end and a second end;

an axial region of the shaft body extending from the second end and being tapered relative to a longitudinal axis of the shaft body such that a cross sectional area of the shaft body at the tapered axial region decreases in a direction from the first end to the second end;

a shaft sleeve mounted on the tapered axial region; and at least one groove indented at the external surface and positioned at the tapered axial region, the at least one groove being arranged to receive a pressurised fluid to facilitate mounting and dismounting of the shaft sleeve at the shaft body.

2. The main shaft as claimed in claim 1, further comprising a fluid inlet conduit extending axially from the second end and provided in fluid communication with the at least one groove to allow a fluid to be supplied to the at least one groove from the second end.

3. The main shaft as claimed in claim 2, wherein the fluid inlet conduit extends internally within the shaft body such that a part of the fluid inlet conduit extends radially outward to the at least one groove.

4. The main shaft as claimed in claim 3, wherein the at least one groove extends in a circumferential direction around the shaft body.

5. The main shaft as claimed in claim 4, wherein the at least one groove extends substantially or completely circumferentially around the shaft body.

6. The main shaft as claimed in claim 5, further comprising a plurality of grooves at the external surface.

7. The apparatus as claimed in claim 6, further comprising a first groove extending in a circumferential direction around the shaft body and a second groove extending in a circumferential direction around the shaft body, the first groove being separated axially from the second groove and coupled in fluid communication.

8. The main shaft as claimed in claim 7, wherein at least a part of the fluid inlet conduit is indented and extends axially at the external surface as a channel to couple the first and second grooves in fluid communication.

9. A gyratory crusher main shaft assembly for a crusher comprising:

a shaft body having a radially outward facing external surface, and a first end and a second end, an axial region of the shaft body extending from the second end and being tapered relative to a longitudinal axis of the shaft body such that a cross sectional area of the shaft body at the tapered axial region decreases in a direction from the first end to the second end, a shaft sleeve mounted on the tapered axial region, and at least one groove indented at the external surface and positioned at the tapered axial region, the at least one groove being arranged to receive a pressurised fluid to facilitate mounting and dismounting of the sleeve at the shaft body; and a sleeve fitted over the tapered axial region, the sleeve having a tapered wall thickness, such that the wall thickness at a second end of the sleeve is greater than the wall thickness at a first end of the sleeve.

10. The assembly as claimed in claim 9, further comprising an end retainer releasably mounted at the second end of the shaft body and having a perimeter region extending radially outward beyond the external surface at the tapered region, the perimeter region positioned to radially overlap the sleeve at the second end of the sleeve to inhibit axial separation of the sleeve from the shaft body.

11. The assembly as claimed in claim 10, wherein the end retainer includes a recess extending circumferentially at the perimeter region to allow axial movement of the sleeve into the recess.

12. The assembly as claimed in claim 9, further comprising a fluid inlet conduit extending axially from the second end of the shaft body in fluid communication with the at least one groove to allow a fluid to be supplied to the at least one groove from the second end of the shaft body.

13. The assembly as claimed in claim 9, further comprising a fluid inlet conduit extending radially through the wall thickness of the sleeve in fluid communication with the at least one groove to allow a fluid to be supplied to the at least one groove through the sleeve.

14. A gyratory crusher comprising;

a main shaft including a shaft body having a radially outward facing external surface, a first end for positioning at a lower region of the crusher and a second end for positioning at an upper region of the crusher relative to the first end, an axial region of the shaft body extending from the second end and being tapered relative to a longitudinal axis of the shaft body such that a cross sectional area of the shaft body at the tapered axial region decreases in a direction from the first end to the second end, the tapered axial region being configured to mount a shaft sleeve;

a sleeve fitted over the tapered axial region, the sleeve having a tapered wall thickness such that a wall thickness at a second upper end of the sleeve is greater than a wall thickness at a first lower end of the sleeve; and at least one groove indented at the external surface and positioned at the tapered axial region, the at least one groove being arranged to receive a pressurised fluid to facilitate mounting and dismounting of the sleeve at the shaft body.

* * * * *